US006159041A

United States Patent [19]

Davis et al.

[11] Patent Number: 6,159,041

[45] Date of Patent: Dec. 12, 2000

[54] ELECTRICAL CONNECTOR ASSEMBLY FOR PANEL MOUNTING

[75] Inventors: Wayne Samuel Davis, Harrisburg; Robert Neil Whiteman, Jr., Middletown, both of Pa.

[73] Assignee: The Whitaker Corporation, Wilmington, Del.

[21] Appl. No.: 09/260,171

[22] Filed: Mar. 1, 1999

[51] Int. Cl.[7] ..... H01R 13/73

[52] U.S. Cl. ..... 439/559; 439/936; 439/942

[58] Field of Search ..... 439/559, 560–564, 439/685, 686, 456, 459, 936, 942

[56] References Cited

U.S. PATENT DOCUMENTS

| | | | |
|---|---|---|---|
| 4,109,992 | 8/1978 | Hughes et al. | 439/685 |
| 5,112,241 | 5/1992 | Chesnut et al. | 439/559 |
| 5,173,057 | 12/1992 | Bunch et al. | 439/685 |
| 5,248,196 | 9/1993 | Lynn et al. | 312/406 |
| 5,425,657 | 6/1995 | Davis et al. | 439/456 |
| 5,568,362 | 10/1996 | Hansson | 439/942 |
| 5,883,511 | 3/1999 | Foster | 439/942 |

OTHER PUBLICATIONS

P. 24 of AMP Catalog No. 82181, published Jul. 1997, entitled Universal MATE–N–LOCK Connectors.

*Primary Examiner*—Hien Vu
*Attorney, Agent, or Firm*—Michael Aronoff

[57] ABSTRACT

An electrical connector assembly (10) for mounting to a panel (80) includes a connector (12) having a housing (14) divided into forward and rearward portions (16, 22) by a peripheral flange (20), a plurality of electrical terminals (78), each terminated to a respective wire (76) and disposed in respective terminal-receiving passageways (40), each wire (76) extending to a wire-receiving face (24) on the rearward portion (22); and a cover (50) configured to be disposed over and surround the rearward housing portion (22) in a closely fitting relationship. A side wall (26) of the rearward housing portion (22) includes a wire-receiving recess 28) extending from the wire-receiving face (24) to the flange (20) and the cover (50) includes a cooperating a wire-receiving recess (60) that together define a wire-receiving passageway (62) proximate the housing flange (20) when the cover (50) is disposed over the rearward portion (22).

16 Claims, 4 Drawing Sheets

ELECTRICAL CONNECTOR ASSEMBLY FOR PANEL MOUNTING

FIELD OF THE INVENTION

This application is related to electrical connectors and more especially to connectors that are mounted to panels and more specifically to connectors suitable for use in foam insulated panels.

BACKGROUND OF THE INVENTION

For purposes of illustrating the invention the connector assembly will be discussed in terms of a connector used in a foamed-in-place insulated wall or door of an appliance. It is to be understood that the panel mounted connector assembly may be used in other equipment and with or without foam insulation.

Appliances such as freezers, refrigerators and the like use foamed-in-place insulation between an inner liner and the outer wall and door panels. To provide electrical power to an electrical apparatus within the refrigerator cabinet a wiring harness is run between the liner and outer panel. Typically one end of each of the wires is terminated to a respective electrical terminal of a connector mounted to the liner and the other end of the wire is terminated to a connector mounted to an outside wall. One example of a wiring harness used in refrigeration with a foamed-in-place insulation is disclosed in U.S. Pat. No. 5,248,196. The electrical connector disclosed therein and similar suitable connectors for use in such an environment typically include one or more seals in the assembly to prevent entrance of the foam generating liquid or the expanding foam into the terminal passageways and the mating area of the connector. The seals are often molded from material that generally is more elastomeric than the material used for the housing. Each wire needs to be inserted through a respective seal. It is desirable and more cost effective, however, to have a connector that is molded from only one material, requires a minimum number of parts, manufacturing processes and assembly steps.

Another method used to block the passageways in the connector includes an overmolded portion formed around the end of the connector after the terminated wires have been inserted into the connector housing. This method also requires additional molding and manufacturing processes.

SUMMARY OF THE INVENTION

The present invention is directed to an electrical connector that is cost effective to manufacture and that minimizes the number of parts and the number of manufacturing processes. The connector includes a housing mountable in a panel and a rear cover that cooperate together to resist invasion of the foam generating liquid and the expanding foam into the terminal-receiving passageways.

The electrical connector assembly for mounting to a panel includes a connector having a housing divided into forward and rearward portions by a peripheral flange, a plurality of electrical terminals, each terminated to a respective wire and disposed in respective terminal-receiving passageways, each wire extending to a wire-receiving face on the rearward portion; and a cover configured to be disposed over and surround said rearward housing portion in a closely fitting relationship. A side wall of the rearward housing portion includes a wire-receiving recess extending from the wire-receiving face to the flange, and the cover includes a cooperating a wire-receiving recess that together define a wire-receiving passageway proximate the housing flange when the cover is disposed over the rearward portion. Upon mounting the connector assembly in a panel, providing a substantially enclosed insulating space around the rearward portion and cover, and injecting a foam generating liquid into enclosed space, the connector assembly resists invasion of the liquid and resultant foamed-in-place insulation between the rearward portion and the cover and into the terminal-receiving passageways.

An additional feature of the invention is that the rearward portion of the connector housing includes at least one chamber between outer walls thereof and the terminal-receiving passageways. The chamber is open to the wirer-receiving face and is adapted to provide expansion space for foamed-in-place insulation should any liquid flow between the rearward portion and the cover.

A further feature of the invention is that the cover includes a peripheral flange at the forward face thereof adapted to engage a rear surface of the housing flange thereby increasing the surface area between the cover and the housing and minimizing air gaps therebetween. The rearward housing portion and the cover further include cooperating latches and latch-receiving openings adapted to secure the cover and rearward portion together in the tight fitting relationship.

In an alternative embodiment of the invention, the wire-receiving recess of the rearward portion and the wirer-receiving recess of the cover include a plurality of cooperating grooves for holding respective ones of the wires in position. Additionally the housing flange may also include a like plurality of slots, each aligned with a corresponding groove for holding a respective wire in position during assembly of the cover to the housing.

Embodiments of the invention will now be described by way of example with reference to the accompanying drawings.

DETAILED DESCRIPTION OF AN EMBODIMENT OF THE INVENTION

Figure 1:
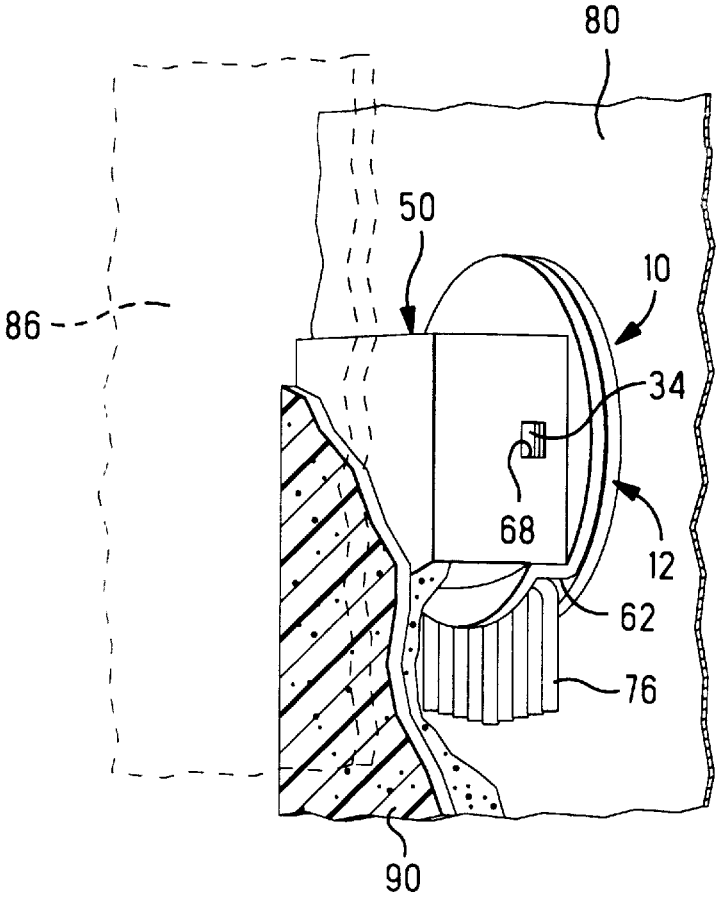
FIG. 1 is an isometric view illustrating a connector assembly of the present invention mounted in a two panel assembly with a fragmentary portion of the second panel being shown in phantom and including a fragmentary portion of insulation.
Figure 3:
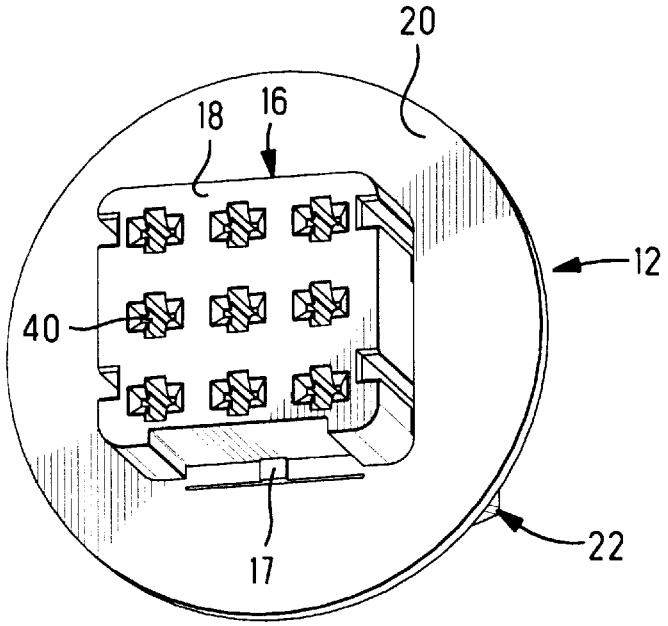
FIG. 3 is an isometric view of the forward portion of the housing of the connector in the assembly of FIG. 1.

Referring now to FIGS. 1 through 5, connector assembly 10 includes a connector 12 and a cover 50. For purposes of illustration, the connector includes nine terminal positions and has a substantially square cross-section. It is to be understood that the invention is not limited to this configuration. Connector 12 includes a housing 14 having a forward portion 16, a rearward portion 22 and a peripheral panel engaging flange 20 therebetween and a plurality of terminal-receiving passageways 40 extending between a mating face 18 on forward portion 16 and an assembly or wire-receiving face 24 on rearward portion 22. When connector assembly 10 is mounted to the liner or inner panel 80, the forward housing portion 16 extends into the cabinet and the rearward portion 22 extends into the space between the liner or inner panel 80 and the outside panel 86. If connector assembly 10 is used at the end of the wiring harness that extends to the outside of the refrigerator or other apparatus, the forward portion 16 would extend through an outer wall or panel 86 and the rearward portion 22 would extend into the space between the two panels 80, 86. The forward housing portion 16 is adapted to be mated to a complementary connector, not shown.

The forward facing surface of flange 20 includes a latch 17 for engaging panel 80. Other methods for securing the connector assembly 10 in panel 80 may also be used. Rearward housing portion 22 includes side walls 26 and end walls 32. One of the side walls 26 further includes a wire-receiving recess 28 extending from the wire-receiving face 24 to the rearward surface of flange 20. The end walls 32 include latches 34 adapted to secure cover 50 to rearward portion 22, as shown in FIG. 1.

Cover 50 includes a front face 52, rear wall 56, side walls 58 and end walls 66 that together define cavity 70 configured to be secured to rearward portion 22 in a closely fitting relationship. Front face 52 includes peripheral flange 54 that extends outwardly in a common plane along three edges of front face 52. The fourth edge of front face 52 includes a wire-receiving recess 60, which cooperates with recess 28 to define a wire receiving passageway 62 when cover 50 is secured to rearward portion 22, as shown in FIG. 1. End walls 66 include latch-receiving openings 68 that cooperate with latches 34 on rearward portion 22 to hold the cover on the connector when assembled thereto.

Figure 2:
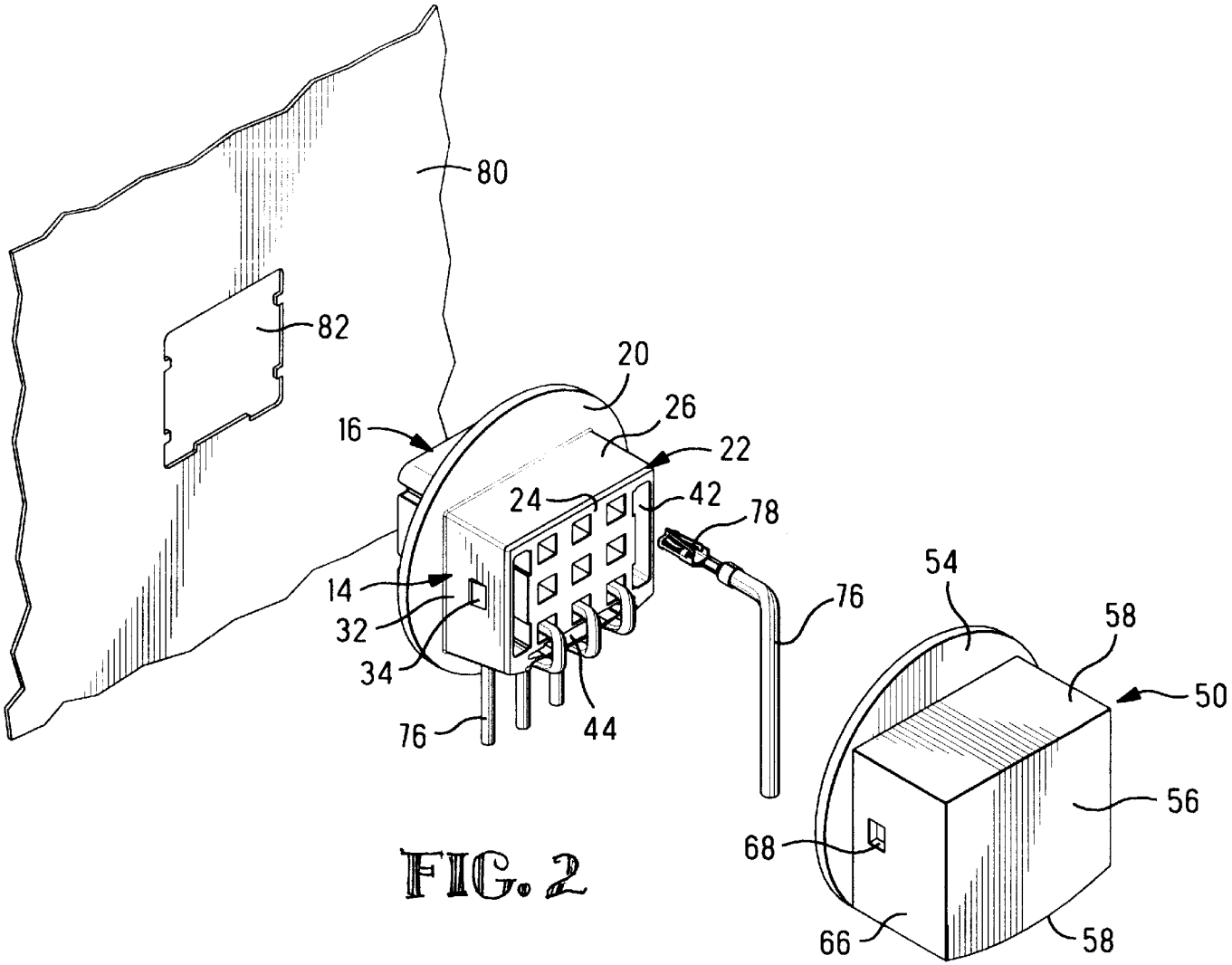
FIG. 2 is an exploded view of the connector assembly of FIG. 1 with the insulation and second panel omitted.

FIGS. 1 and 2 also show the position of wires 76 as they exit the respective terminal-receiving passageways 40 along the wire-receiving face 24. In FIG. 2 for purposes of clarity, only three wires 76 are shown in the housing and a fourth wire 76 having terminal 78 terminated to the end of wire 76 is exploded therefrom. Terminal 78 is shown as a receptacle terminal. It is to be recognized that any of a variety of terminal styles may be used. The wires 76 are brought out of the passageways 40 and directed along surface 24, wrapped around an edge of side wall 26 and into wire-receiving passageway 62 recess 28 until they reach flange 20 where they are bent to lie along flange 20. Upon securing cover 50 on rearward portion 22, wires 76 are trapped in the wire-receiving passageway 62 in a closely spaced and aligned relationship thereby minimizing the spaces into which the foam generating liquid or resulting foam can flow when insulation is foamed-in-place between the inner and outer panels.

Figure 4:
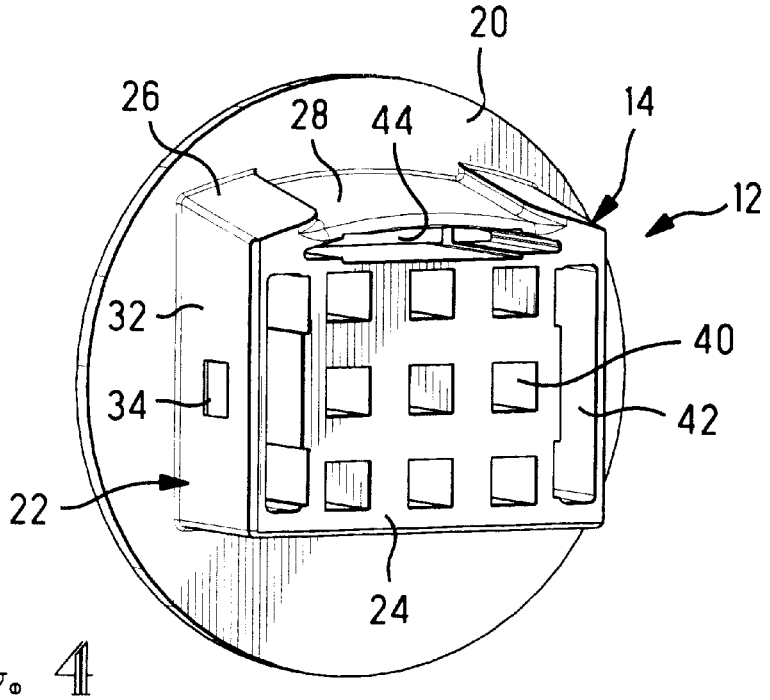
FIG. 4 is an isometric view of the rearward portion of the housing of the connector in the assembly of FIG. 1.
Figure 5:
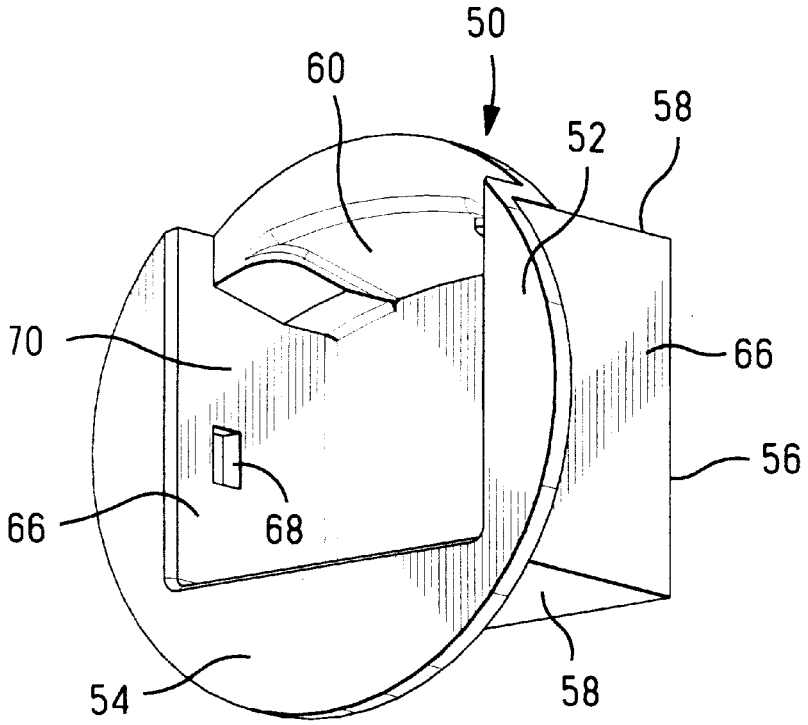
FIG. 5 is an isometric view of the cover of the assembly of FIG. 1.

FIGS. 2 and 4 also show side cores or chambers 42 and core 44 that are formed in rearward portion 22 to allow space for expansion of any foam generating liquid that may enter the assembled connector 10 during the manufacturing process. Core 44 of rearward portion 22 also is adapted to receive a core pin in the molding process used to form one or more latches 17 or other features for securing connector assembly 10 in panel opening 82, as shown representatively in FIG. 3.

For cost effective manufacturing, connector housing 14 and cover 50 are configured to be molded in respective single pull molds with simple side actions to form the latches. Connector 12 is then completed by terminating electrical terminals 78 to respective wires 76 and inserting the terminals and ends of the wires into respective terminal-receiving passageways 40. Wires 76 are then positioned as described above. Cover 50 is attached to the rearward portion 22 and secured thereto by means of latches 34 engaging openings 68. The other ends of wires 76 (not shown) may be terminated to another connector or may extend to an opening in the outer panel.

The cabinet assembly is made by positioning connector assembly 10 in panel opening 82 of liner or panel 80, as illustrated in FIGS. 1 and 2. After the connector and any other devices or hardware is in place, the outer shell or panel 86 is secured to the inner panel thereby defining an enclosed space for receiving insulation. The foam generating liquid is inserted between the two panels 80, 86 and the insulation is foamed-in-place and embedding the rearward connector portion 22, the cover 50, and the wires 76 therein. The material reacts rapidly to form insulating foam 90, as shown pictorially in FIG. 1. The insulation expands and fills any air gaps in the system. The tightly aligned and secured wires 76 in passageway 62 of connector assembly 10 essentially block the foam generating liquid from penetrating the assembly. If any liquid does enter between the housing and cover, it has to follow a circuitous path to reach the terminal-receiving passageways 40. Additionally chambers 42 and 44 provide space for expansion of any liquid that may enter the assembly.

Figure 6:
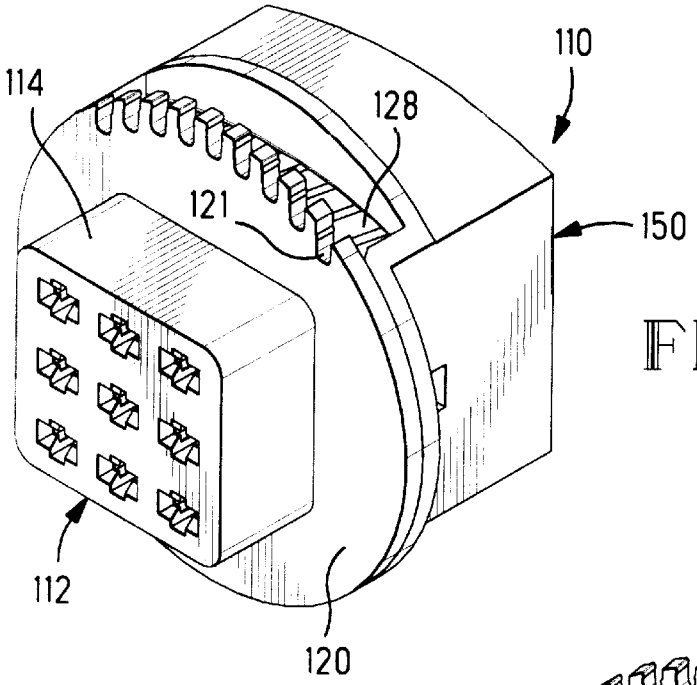
FIG. 6 is an isometric view of an alternative embodiment of the connector assembly.
Figure 7:
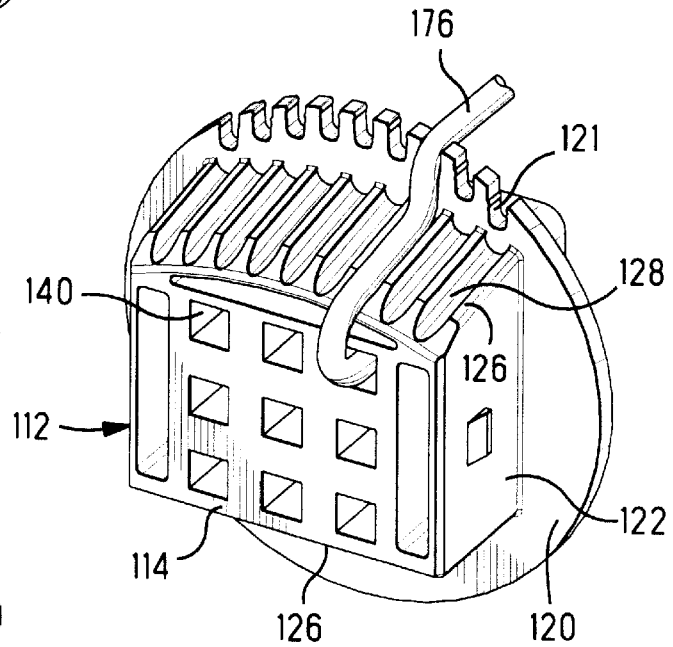
FIG. 7 is an isometric view of the connector in the assembly of FIG. 6.
Figure 8:
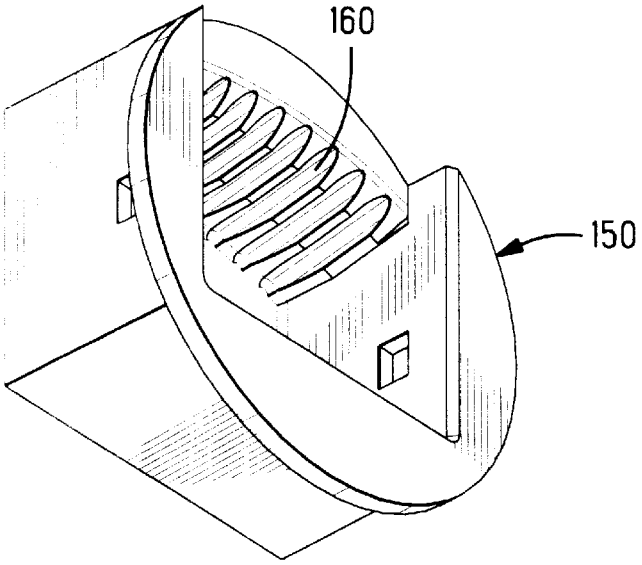
FIG. 8 is an isometric view of the cover in the assembly of FIG. 6.

FIGS. 6 through 8 illustrate an alternative embodiment 110 of the connector assembly. In this embodiment, housing 114 of connector 112 includes a plurality of wire-receiving grooves 128 extending along side wall 126 and a corresponding number of slots 121 in flange 120. Each wire 176 extends outwardly of a terminal-receiving passageway 140, along a corresponding groove 128 and is temporarily held in alignment in a corresponding slot 121, as shown representatively in FIG. 7. All of the wires 176 are laced in the same manner and held in the respective slots 121 until cover 150 has been assembled to rearward portion 122 of housing 114. As can best be seen in FIG. 8, the inner surface of cover 150 includes wirer-receiving grooves 160 that cooperate with grooves 128 to securely hold the wires in position. After cover 150 has been secured to housing 14, wires 176 are brought into position against the rear surface of flange 120.

The connector assemblies 10, 110 provide a connector and cover for use in an assembly of two panels having foamed-in-place insulation. The structure of the housing and cover and the circuitous pathway of the wires substantially prevent intrusion of foam generating liquid into the terminal-receiving passageways of the connector. The assembly of the present invention is cost effective to manufacture. The assembly eliminates the need to mold parts from two different materials, reduces the number of parts needed as compared to the prior art connectors and minimizes manufacturing and assembly processes. Additionally, by eliminating the need for individual wire seals, the present invention permits more than one wire to be terminated to a single terminal if desired.

It is thought that the electrical connector assemblies of the present invention and many of the attendant advantages will be understood from the foregoing description. It is apparent that various changes may be made in the form, construction, and arrangement of parts thereof without departing from the spirit or scope of the invention, or sacrificing all of its material advantages.

We claim:

1. An electrical connector assembly, comprising:

a connector housing divided into forward and rearward portions by a peripheral flange adapted to engage a rear surface of a panel, the housing including a plurality of terminal-receiving passageways;

a plurality of electrical terminals, each one of the plurality of terminals disposed in one of the plurality of terminal-receiving passageways, each of the plurality of terminals being terminated to a wire, each said wire extending to a wire-receiving face of the housing rearward portion;

a cover configured to be disposed over and surround said housing rearward portion in a closely fitting relationship; and a side wall of said housing rearward portion including a wire-receiving recess extending from said wire-recieving face to a surface of said flange, said wire-receiving recess being adapted to receive each said wire when each said wire is brought from said wirer-receiving face to said side wall and wrapped forwardly toward said flange;

said cover including a wire-receiving recess along an interior surface of a side wall thereof adapted to cooperate with said wire-receiving recess of said housing rearward portion to define a wire-receiving passageway proximate said housing flange when said cover is disposed over said housing rearward portion, such that each said wire is aligned and tightly held in said passageway thereby minimizing air gaps around each said wire;

wherein the terminal-receiving passageways are substantially sealed from invasion of a foam generating liquid via the wire-receiving passageway.

2. The connector assembly of claim 1 wherein said rearward portion of said connector housing includes at least one chamber between outer walls thereof and said terminal-receiving passageways, said chamber being open to said wire-receiving face, said at least one chamber being adapted to receive any of the foam generating liquid that passes between said rearward portion and said cover.

3. The connector assembly of claim 1 wherein said cover includes a peripheral flange at the forward face thereof adapted to engage a rear surface of said housing flange thereby increasing the surface area at an interface between the cover and the housing and minimizing air gaps therebetween.

4. The connector assembly of claim 1 wherein said rearward housing portion and said cover include cooperating latches and latch-receiving openings adapted to secure said cover and rearward portion together in said tight fitting relationship.

5. The connector assembly of claim 1 wherein said housing wire-receiving recess and said cover wire-receiving recess include a plurality of cooperating grooves, each said groove for holding a wire in position.

6. The connector assembly of claim 5 wherein said housing flange includes a plurality of slots, each slot aligned with a corresponding groove for holding a respective wire in position during assembly of the cover to housing.

7. The connector assembly of claim 1 wherein said housing flange includes a plurality of slots, each slot adapted to hold a wire in position during assembly of the cover to the housing.

8. The connector assembly of claim 1 wherein the housing wirer-receiving recess and the cover wire-receiving recess are configured to align and tightly hold each said wire in the passageway.

9. An electrical connector assembly for mounting to a panel a connector including a connector having a housing with a peripheral flange dividing said housing into a forward portion adapted to extend forwardly through said panel, and a rearward portion adapted to extend rearwardly from said panel, said connector including a plurality of electrical terminals, each one of the plurality of terminals terminated to a respective wire and disposed in one of the plurality of terminal-receiving passageways, each said wire extending to a wirer-receiving face of the housing rearward portion, the assembly comprising:

a side wall of said rearward housing portion including a wire-receiving recess extending from said wire-receiving face to said flange, said wirer-receiving recess being adapted to receive each said wire when each said wire is brought from said wire-receiving face to said side wall and wrapped forwardly toward said flange;

a cover surrounding said housing rearward portion in a closely fitting relationship, said cover including a wire-receiving recess along an interior surface of a side wall thereof that cooperates with said wirer-receiveing recess of said housing rearward portion to define a wirer-receiving passageway proximate said housing flange when said cover is assembled to said housing rearward portion, such that each said wire is aligned and tightly held in said passageway;

wherein the terminal-receiving passageways are substantially sealed from invasion of a foam generating liquid via the wire-receiving passageway.

10. The connector assembly of claim 9 wherein said rearward portion of said connector housing includes at least one chamber between outer walls thereof and said terminal-receiving passageways, said chamber being open to said wire-receiving face, said at least one chamber being adapted to receive any of the foam generating liquid that passes between said rearward portion and said cover.

11. The connector assembly of claim 9 wherein said cover includes a peripheral flange at the forward face thereof adapted to engage a rear surface of said housing flange thereby increasing the surface area at the interface between the cover and the housing and minimizing air gaps therebetween.

12. The connector assembly of claim 9 wherein said rearward housing portion and said cover include cooperating latches and latch-receiving openings adapted to secure said cover and rearward portion together in said tight fitting relationship.

13. The connector assembly of claim 9 wherein said housing wire-receiving recess and said cover wire-receiving recess include a plurality of cooperating grooves, each said groove for holding a wire in position.

14. The connector assembly of claim 13 wherein said housing flange includes a plurality of slots, each slot aligned with a corresponding groove for holding a respective wire in position during assembly of the cover to housing.

15. The connector assembly of claim 9 wherein said housing flange includes a plurality of slots, each slot adapted to hold a wire in position during assembly of the cover to the housing.

16. The connector assembly of claim 9 wherein the housing wire-receiving recess and the cover wire-receiving recess are configured to align and tightly hold each said wire in the passageway.

* * * * *